US006343944B1

(12) United States Patent
Okabe

(10) Patent No.: US 6,343,944 B1
(45) Date of Patent: Feb. 5, 2002

(54) CONNECTOR SUPPORTING MECHANISM

(75) Inventor: Toshiaki Okabe, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/453,921

(22) Filed: Apr. 28, 2000

(30) Foreign Application Priority Data

May 21, 1999 (JP) ..... 11-141733

(51) Int. Cl.[7] ..... H01R 13/20
(52) U.S. Cl. ..... 439/157
(58) Field of Search ..... 439/157, 152, 439/544–557, 701

(56) References Cited

U.S. PATENT DOCUMENTS

| | | | |
|---|---|---|---|
| 5,873,745 | A | 2/1999 | Duclos et al. |
| 5,954,528 | A | 9/1999 | Ono et al. |
| 5,954,532 | A | 9/1999 | Matsuura et al. |
| 6,030,239 | A | 2/2000 | Liu |
| 6,050,838 | A | 4/2000 | Norizuki et al. |
| 6,093,040 | A | 7/2000 | Kodama et al. |
| 6,120,308 | A | 9/2000 | Hayashi |
| 6,126,470 | A | 10/2000 | Ono |
| 6,168,827 | B1 | 2/2001 | Okabe |

FOREIGN PATENT DOCUMENTS

| | | |
|---|---|---|
| JP | 59-20578 | 2/1984 |
| JP | 10-021992 | 1/1998 |

OTHER PUBLICATIONS

Patent Application Serial No. 09/583,012, Toshiaki Okabe, May 30, 2000.
Patent Application Serial No. 09/583,014, Toshiaki Okabe, May 30, 2000.

*Primary Examiner*—P. Austin Bradley
*Assistant Examiner*—Larisa Tsukerman
(74) *Attorney, Agent, or Firm*—Finnegan, Henderson, Farabow, Garrett & Dunner, L.L.P.

(57) ABSTRACT

A first connector 30 comprises a connector body 31, and an engaging lever 32 pivotally supported by a pivot 33 such that one end of the engaging lever project from one end surface of the connector body 31. An engaging projection 43 project from one end of the engaging lever 32, and a connecting projection 40D projects from the other end of the engaging lever 32. A second connector 50 is formed at its inner wall with a guide groove 54 for guiding the connecting projection 40D. By fitting the second connector 50 to the first connector 30 in a temporarily mounting state in which the engaging projection 43 engages the mounting member 20, the connecting projection 40D is guided in the guide groove 54 to turn the engaging lever 32, and the engaging projection 43 is supported by the mounting member 20.

5 Claims, 20 Drawing Sheets

CONNECTOR SUPPORTING MECHANISM

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Description of Related Art

Conventionally, as a connector supporting mechanism of this kind, there is known a technique as described in Japanese Patent Application Laid-open No. H10-21992. This prior art has a structure as shown in FIGS. 1 to 3. A connecting mechanism of this conventional connector will be explained with using FIGS. 1 to 3 below.

This connector connecting mechanism comprises a holder 2 mounted into a mounting hole 1A formed in a mounting member (mounting plate) 1 such as a stay member of an automobile as shown in FIG. 1. The connector connecting mechanism further comprises, a first connector 3 which is slidably fitted in the holder 2 and a second connector 5 connected to an electronic unit 4. A swinging lever 6 for driving the second connector 5 into a direction to connect with the first connector 3 is turnably supported around a pivot 6A by the first connector 3.

The holder 2 is formed into a substantially cylindrical shape, and includes a pair of upper and lower horizontal plates 7 and 8, and a pair of left and right side plates 9 and 10 as shown in FIG. 1. The holder 2 is inserted into the mounting hole 1A formed in the subject member 1 and fixed therein by fixing means such as screw. The side plates 9 and 10 of the holder 2 are formed at their inner wall surfaces with guide grooves 11 and 12 along the longitudinal direction for slidably guiding the first connector. The horizontal plate 7 is formed with a guide groove 13 with which an engaging pin 6B projecting from an upper surface of a rear end of the swinging lever 6 is engaged and guided. The guide groove 13 comprises an introducing portion 13A rearwardly extending from a front end of the holder 2, an arc driving grove portion 13B extending from an end of the introducing portion 13A rearwardly and inwardly, and a locking groove portion 13C extending from an end of the driving groove portion 13B rearwardly. The driving groove portion 13B guides the engaging pin 6B along an arc as the first connector 3 is inserted into the holder 2. With the motion of this engaging pin 6B, the swinging lever 6 swings.

An engaging groove 6C is formed in a lower surface of a front end of the swinging lever 6. A driven pin 5A projecting from the second connector 5 engages the engaging groove 6C. Another swinging lever 6 is also formed on the other side surface of the first connector 3. Another driven pin 5A (not shown) is also projecting from the other side surface of the second connector such as to correspond to the other swinging lever formed on the other side surface.

In FIG. 1, the reference symbol 3A represents a pair of slide projections projecting from a rear end of each of opposite sides of the first connector 3. The slide projections 3A are guided by the guide grooves 11 and 12 formed in the inner walls of the side plates 9 and 10 of the holder 2. As shown in FIGS. 1 and 3, a temporarily mounting portion 3B for temporarily mounting the first connector 3 into a front opening of the holding is formed between each of the pair of the slide projections formed on both sides of the first connector Further, as shown in FIGS. 1 and 2, a pair of falling-out preventing projections 3C and 3C are projecting from each of the opposite sides of the rear end of upper and lower surfaces of the first connector 3. Falling-out preventing portions 2A are formed on the front end opening peripheral edges of the holder 2 so as to correspond to the falling-out preventing projections 3C and 3C. The projections 3C are fitted into temporarily mounting positions of the holder 2 for preventing the first connector 3 from falling out from the holder 2 by the falling-out preventing portions 2A.

However, according to the connecting mechanism of the connectors, it is necessary to mount the holder 2 to the mounting hole 1A formed in the mounting member 1 before the first connector 3 and the second connector 5 are mounted to the mounting member 1 such as a stay member of an automobile, and there is a problem that the number of parts is increased. Especially, in the prior art, since the swinging lever 6 is rotated and driven if the engaging, pin 6B engaged in the guiding groove 13 of the holder 2 is guided, it is necessary to precisely set size and shape of the guide groove 13 formed in the holder 2.

Further, according to the above-described conventional mechanism, in order to temporarily mount the first connector 3 to the holder 2 at an initial position of the inserting motion, it is necessary to form the temporarily mounting portion on the side of the first connector 3. As a result, it is necessary to form the temporarily mounting projection 2B also on the side of the holder 2 as shown in FIG. 3. In addition, in order to prevent the first connector 3 inserted into the initial position of the inserting motion from falling out from the holder 2, it is necessary to form the falling-out preventing projections 3C on the first connector 3, and to form the falling-out preventing portions 2A also on the side of the holder 2. In the conventional mechanism, since the temporarily mounting mechanism and the falling-out preventing mechanism are formed on each of the members, there is a problem that the mechanisms become complicated.

Therefore, according to the conventional connector connecting mechanism, since the number of parts is great and mechanisms are complicated, a mounting space is required, and the mounting operation is complicated. For these reasons, in the conventional engaging mechanism, there is a problem that the costs of parts and operational costs are high.

Further, the temporarily mounting portion 3B formed on the first connector 3 and the falling-out preventing portions 2A formed on the holder 2 are portions which are set such that they are resiliently deformed when the first connector 3 is inserted into the holder 2. There is an adverse possibility that these portion may be bent or damaged by strong external force caused when a wire harness connected to the first connector 3 is handled or when the holder 2 and the first connector 3 are assembled at improper position.

Further, in the conventional connector connecting mechanism, when the first connector 3 is inserted into the mounting member 1 such as a stay member of an automobile, it is necessary to fit the engaging pin 6B projecting from the rear end of the swinging lever 6. In the state in which the first connector 3 is inserted into the holder 2 in this manner, since the swinging lever 6 can swing freely, there are problems that some experience is required to insert the engaging pin 6B into the introducing portion 12A of the guide groove 13, and the assembling operation is complicated.

2. Field of the Invention

The present invention relates to a connector supporting mechanism, and more particularly, to a connector supporting mechanism for supporting and fixing a pair of female and male mutually connected connectors to a supporting body.

SUMMARY OF THE INVENTION

It is an object of the present invention to provide an inexpensive connector supporting mechanism capable of reducing the number of parts and an assembling operation can easily and reliably be carried out.

According to a first aspect of the present invention, there is provided a connector supporting mechanism comprising a mounting member, a first connector supported by the mounting member, and a second connector assembled to and electrically connected to the first connector to be mounted to said mounting member, wherein the first connector comprises a connector body and an engaging lever pivotally supported by a rotation supporting shaft such that one end of the engaging lever project from one of end surfaces of the connector body, an engaging projection projects from the one end of the engaging lever, and a connecting projection projects from the other end of the engaging lever, the second connector is formed at its wall with a guide groove for guiding the connecting projection, the connecting projection is guided in the guide groove to turn the engaging lever by fitting the first connector to the second connector in a temporarily mounting state in which the engaging projection is engaged with the mounting member, and the engaging projection is supported by the mounting member.

Therefore, according to the first aspect of the invention, the connecting projection is guided in the guide groove to turn the engaging lever by fitting the first connector to the second connector in a temporarily mounting state in which the engaging projection is engaged with the mounting member, and the engaging projection can be engaged with the mounting member reliably, and the second connector can be connected to the first connector reliably.

According to a second aspect of the invention, the mounting member comprises a mounting panel having a mounting opening, a sliding projection is formed at a position nearer to the rotation supporting shaft than the engaging projection formed on the one end of the engaging lever, the engaging, projection is engaged with a back surface of the mounting panel, and the sliding projection is engaged with a front surface of the mounting panel.

According to the second aspect, the temporarily mounting state is established by engaging the connecting projection inserted into the back surface of the mounting panel with the back surface of the mounting panel, and it is unnecessary to fix the first connector by separate fixing means. Further, since the mounting panel is sandwiched between the engaging projection and the sliding projection by engaging the sliding projection with the front surface of the mounting panel, the first connector can be strongly supported by the mounting panel.

According to a third aspect of the invention, in the above connector supporting mechanism, as the second connector is fitted to the first connector in a temporarily mounting state in which the engaging projection is engaged with the back surface of the mounting panel and the sliding projection is engaged with the front surface of the mounting panel, the connecting projection moves along the guide groove to turn the engaging lever, and the engaging projection comes into contact with the back surface of the mounting panel under pressure.

According to the third aspect, since the connecting projection is guided into the guide groove to turn the engaging lever by fitting the second connector to the temporarily mounted first connector, the first connector can be fixed to the mounting panel and both the connectors can be fitted to each other at the same time.

According to a fourth aspect of the invention, in the above connector supporting mechanism, the engaging lever is provided on each of opposite surfaces of the connector body.

According to the fourth aspect, since the engaging lever is provided on each of opposite surfaces of the connector body (first connector), the first connector is stably temporarily mounted or fixed to the mounting panel which is a mounting member. Therefore, it is possible to obtain a connector supporting mechanism capable of stably and strongly connecting the assembling state.

According to a fifth aspect of the invention, in the above connector supporting mechanism, stoppers project sideways from opposite sides of the one end of the connector body, and resilient pieces are mounted to the other end of the stoppers.

According to the fifth aspect, since the one end of the connector body is provided at its opposite sides with stoppers and resilient pieces, it is possible to obtain load center of the resilient pieces and the sliding projections and therefore, it is possible to enhance the stability of holding force of the first connector in its temporarily mounted state.

DETAILED DESCRIPTION OF THE PREFERRED EMBODIMENTS

Figure 1:
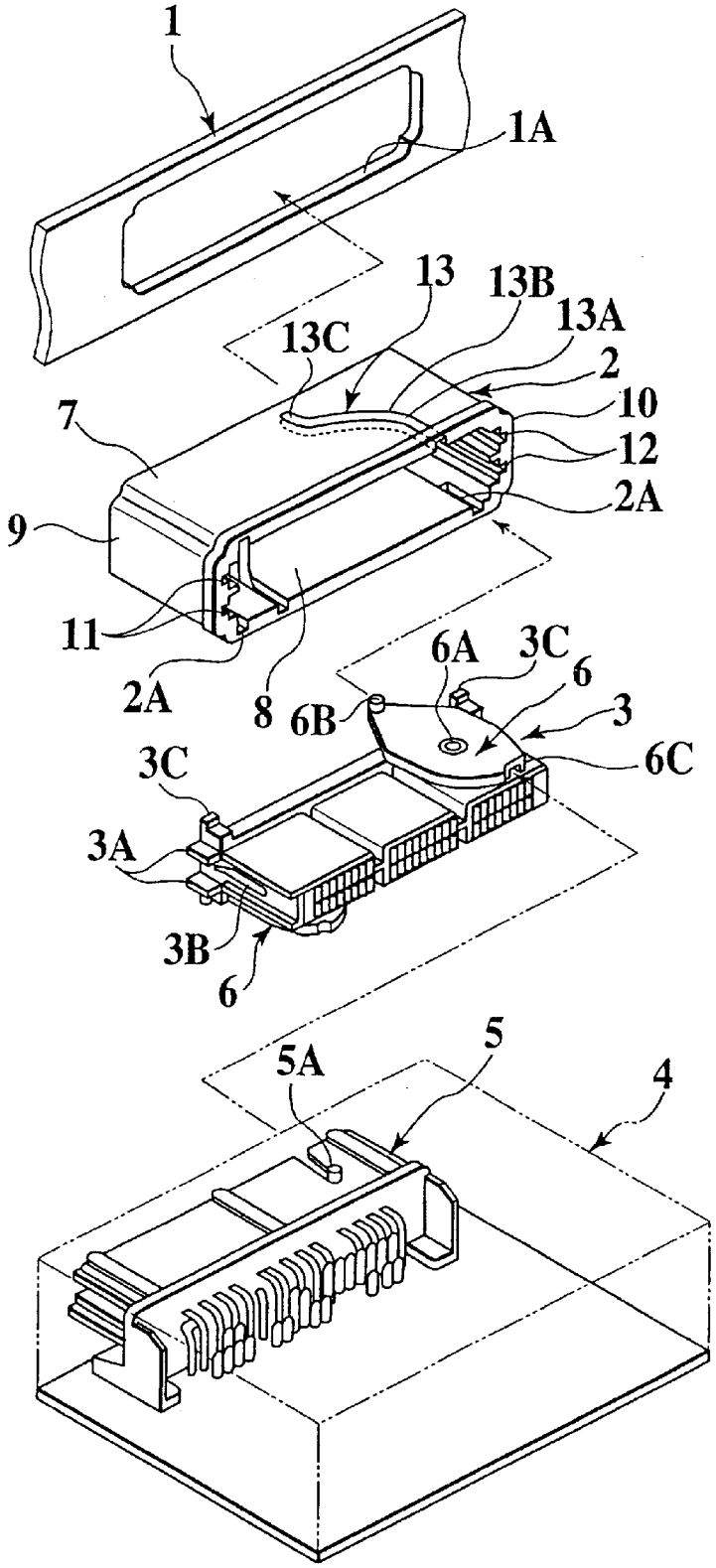
FIG.1 PRIOR ART
FIG. 1 is an exploded perspective view showing a conventional connector supporting mechanism.
Figure 2:
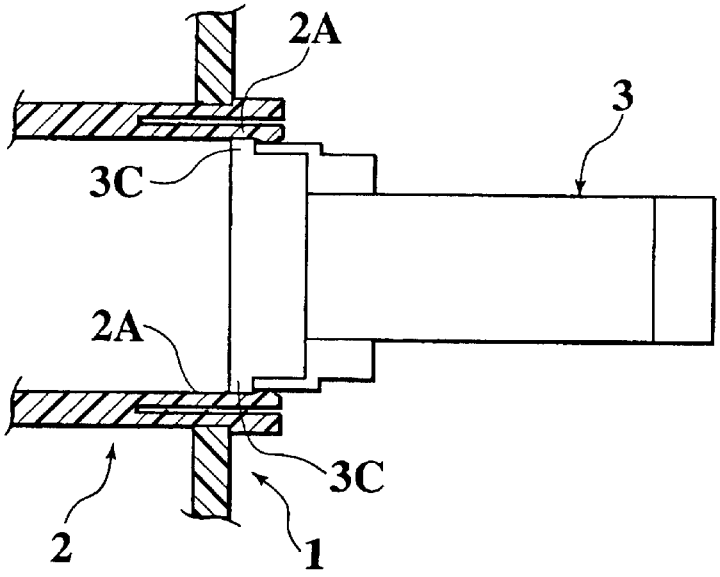
FIG.2 PRIOR ART
FIG. 2 is a partial side sectional view showing the conventional connector supporting mechanism.
Figure 3:
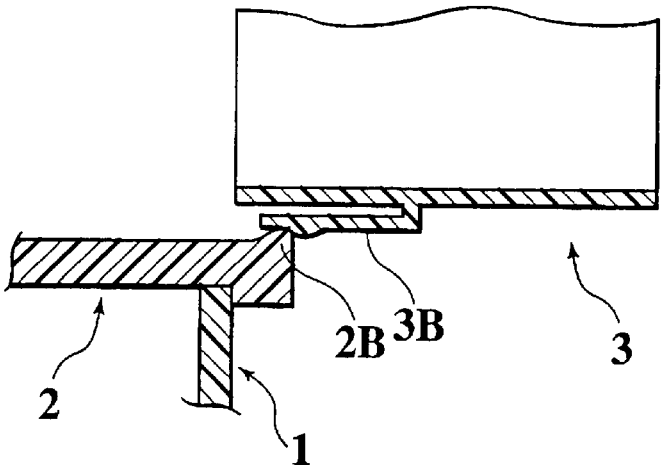
FIG.3 PRIOR ART
FIG. 3 is a plan sectional view of an essential portion of the conventional connector supporting mechanism.

Details of a connector supporting mechanism according to the present invention will be explained based on embodiments shown in the drawings.

First Embodiment

FIGS. 4 to 11 show a first embodiment of a connector supporting mechanism according to the present invention. The connector supporting mechanism of the present embodiment comprises a mounting member 20, a first connector 30 as a male connector to be mounted to the mounting member 20, and a second connector 50 as a female connector to be mounted to the first connector 30.

Figure 4:
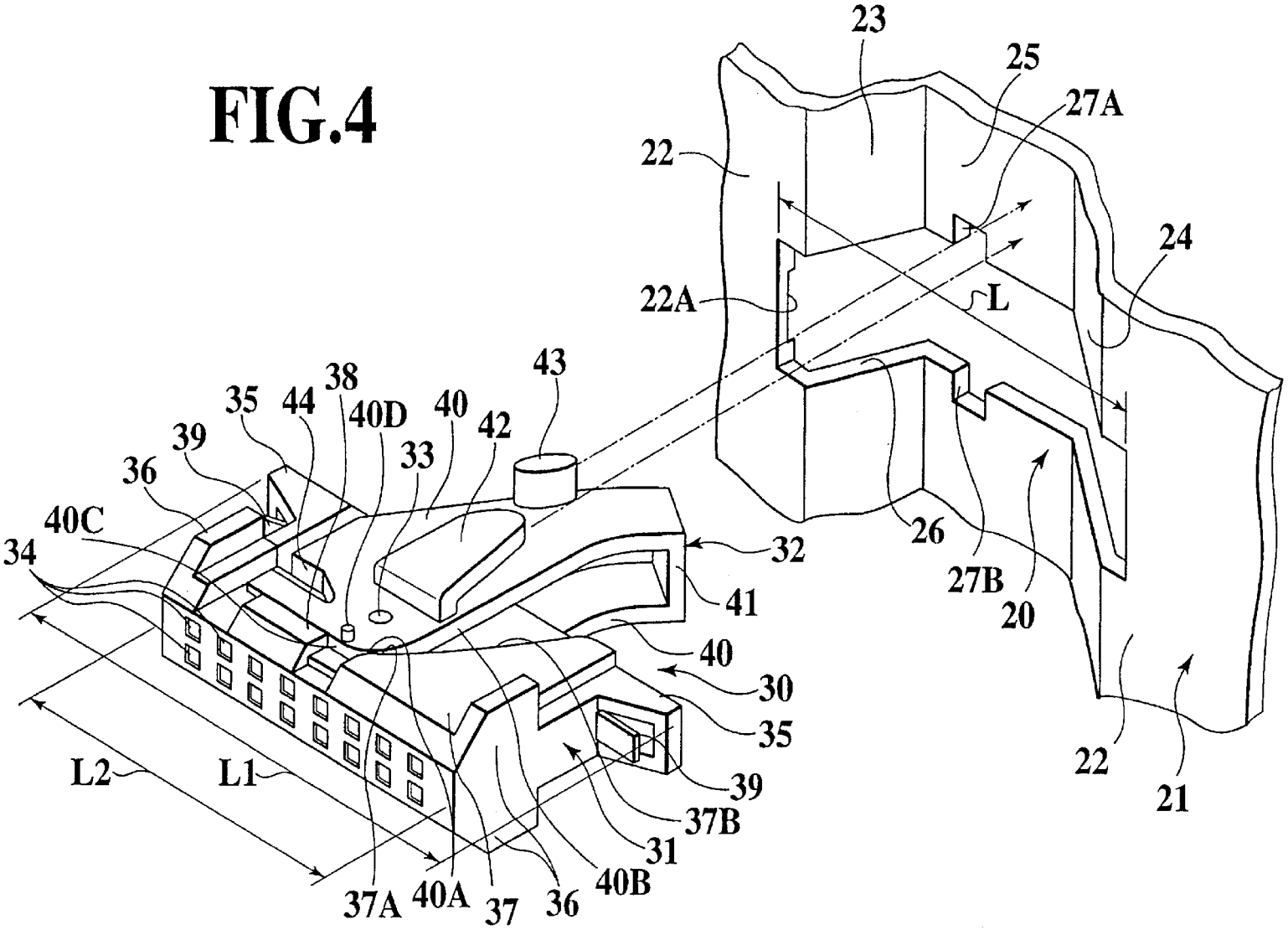
FIG. 4 is a perspective view showing a mounting member and first connector constituting a connector supporting mechanism according to a first embodiment of the present invention.

First, a structure of the mounting member 20 will be explained. The mounting member 20 is formed on a stay member 21 of an automobile for example. As shown in FIG. 4, this mounting member 20 includes two inclined surfaces 23 and 24 forming a recess groove with respect to reference surfaces 22 and 22 of the stay member 21, and a bottom surface 25. The mounting member 20 is also formed with a mounting opening 26 having a width narrower than a maximum width of a first connector body which will be described later. The opening 26 is formed from the entire width of the recess Groove formed by the inclined surfaces 23, 24 and the bottom surface 25 to the reference surfaces 22 and 22 on opposite sides.

Insertion notches 27A and 27B through which engaging projections 43 and 43 formed on the first connector 30 which will be described later are formed in upper and lower edges of the bottom surface 25 facing the mounting opening 26. Recess groove-like steps 22A and 22A each having a predetermined length from the opening 26 to widthwise outward are formed on back surfaces of the reference surfaces 22 and 22 facing the mounting opening 26.

Next, a structure of the first connector 30 will be explained. As shown in FIG. 4, the first connector 30 includes a substantially rectangular first connector body 31, and an engaging lever 32 which is pivotally supported by pivots and at upper and lower surfaces of the substantially rectangular first connector body 31. As shown in FIGS. 4 and 5B, the first connector body 31 is formed with a plurality of terminal accommodating chambers 34 which longitudinally pass through the first connector body 31. In the first embodiment, female terminal metal fittings are accommodated in the terminal accommodating chambers 34. Electric wires are connected to the female terminal metal fittings. These electric wires are led out from one end (rear end, hereinafter) of the first connector body 31 and led toward the back surface of the stay member 21 through the mounting opening 26.

Figure 5A:
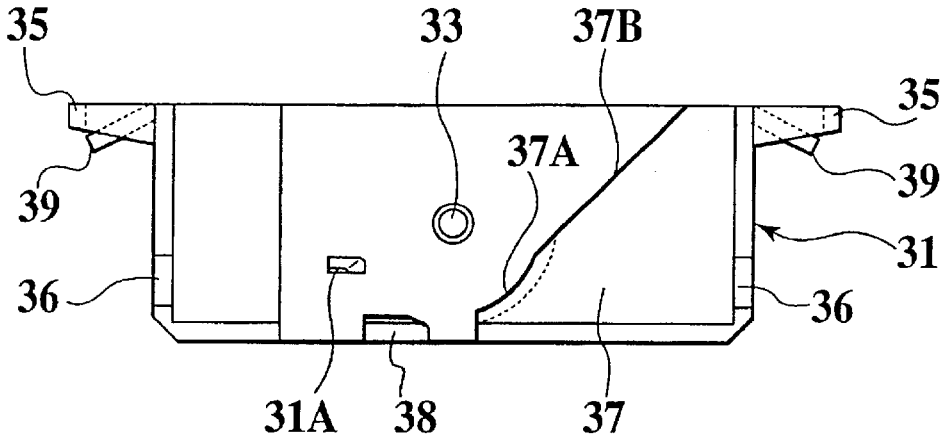
FIG. 5A is a plan view showing a first connector body according to the first embodiment.
Figure 5B:
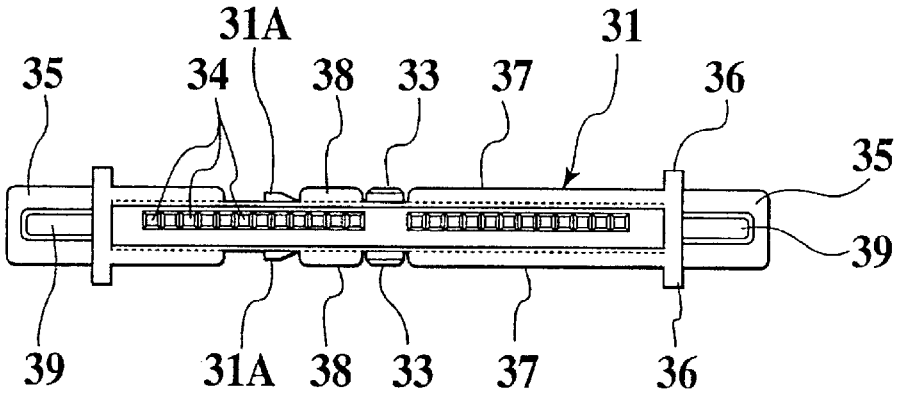
FIG. 5B is a front view thereof.
Figure 5C:
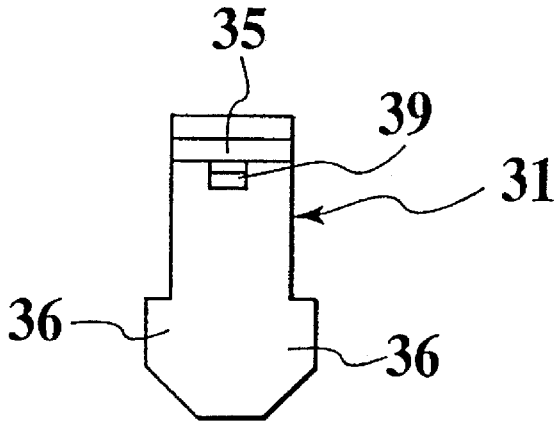
FIG. 5C is a side view thereof.

As shown in FIGS. 4, 5A and 5B, stoppers 35 project sideway from opposite sides of the rear end from which the electric wires of the first connector body 31 are led out. FIGS. 5A and 5B show a state in which the engaging lever 32 is not mounted to the first connector body 31. As shown in FIG. 4, a length L1 between tip ends of these stoppers 35 and 35 is set longer than a width L of the mounting opening 26 of the stay member 21. A width L2 of the first connector body 31 is set slightly shorter than the width L of the mounting opening 26. Each of the stopper 35 is provided at its front side with a resilient piece 39 biased in a direction separating away from the stopper 35. This resilient piece 39 exhibits a holding force during an initial stage for mounting the first connector 30 to the mounting member 20 as will be explained later.

Further, a pair of vertically projecting guide projections 36 and 36 are formed on opposite sides of the other end (front end, hereinafter) of the first connector 30. Upper and lower surfaces of the front end of the first connector 30 are formed with a first projection 37 having substantially triangular plane and a second projection 38 having substantially rectangular plane for restricting a rotation range of the engaging lever 32. The first connector 30 is formed at its front end with a guide inclined surfaces 36A and 38A. In FIGS. 5A and 5B, the reference symbol 31A represents a temporarily mounting projection for temporarily mounting the engaging lever 32.

Figure 6A:
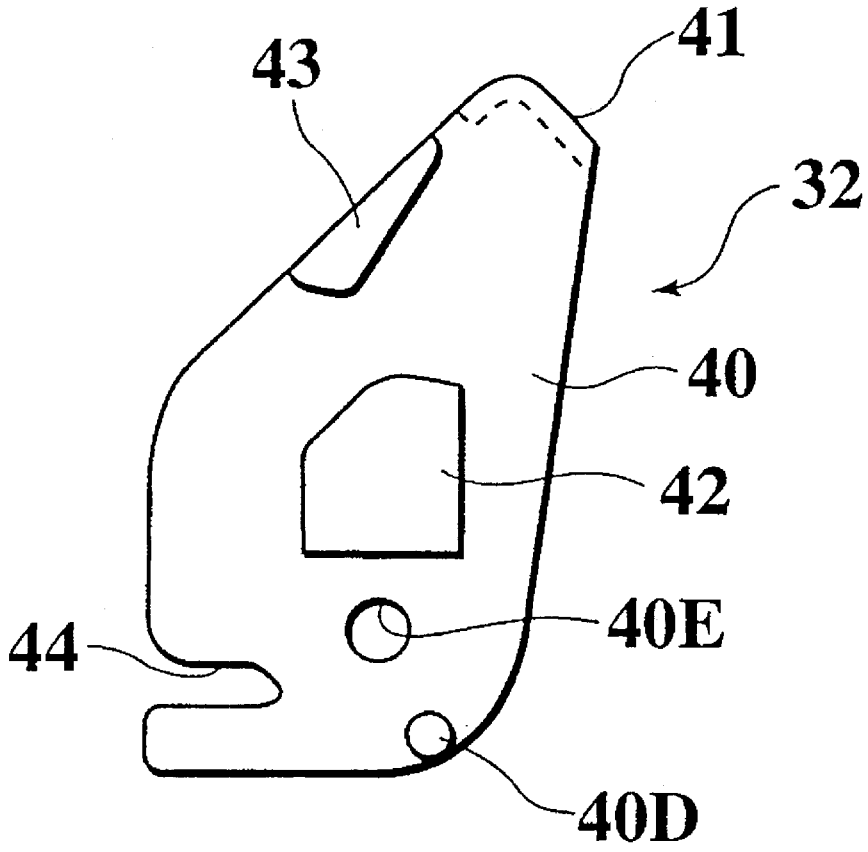
FIG. 6A is a plan view showing an engaging lever according to the first embodiment.
Figure 6B:
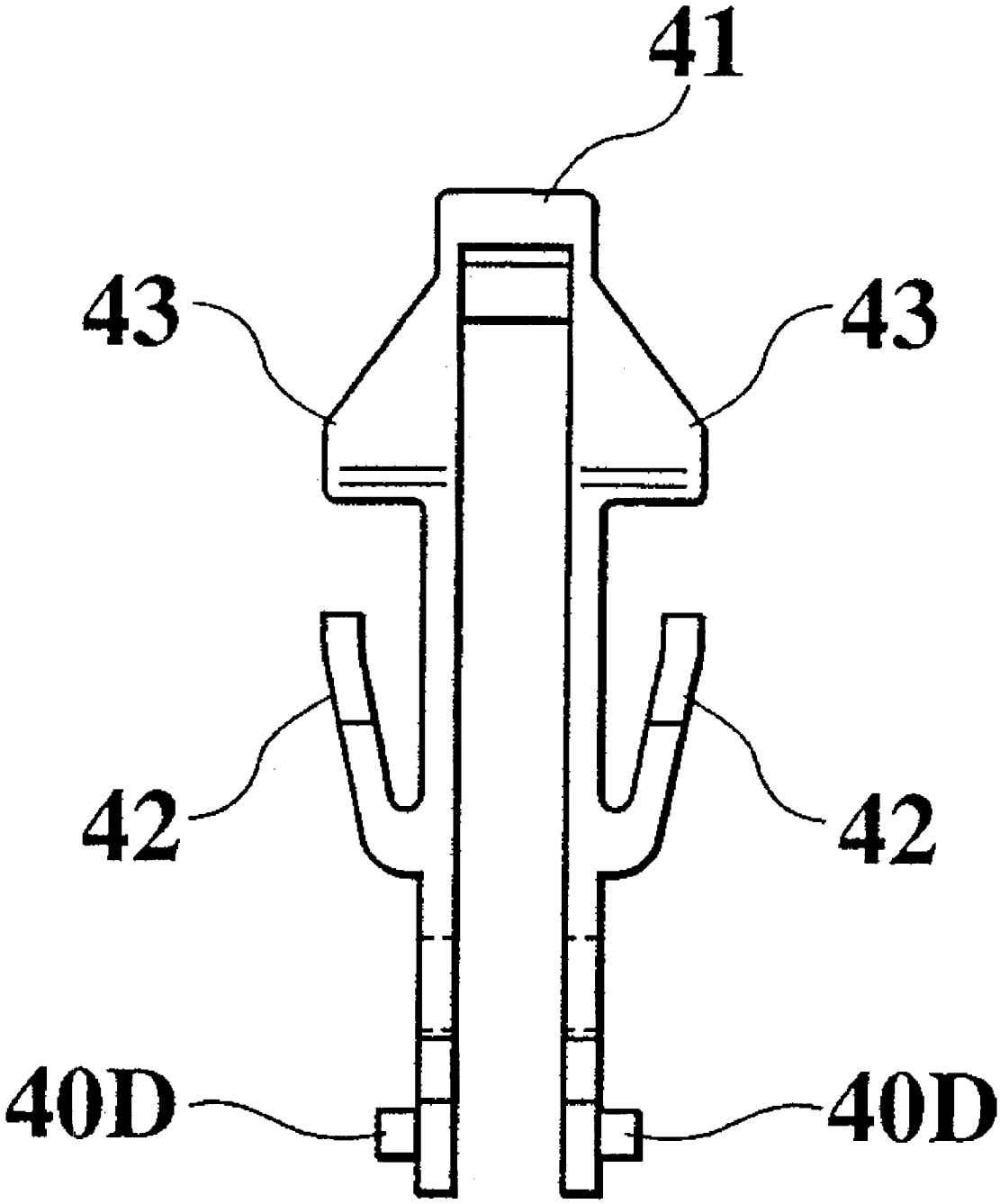
FIG. 6B is a side view thereof.
Figure 6C:
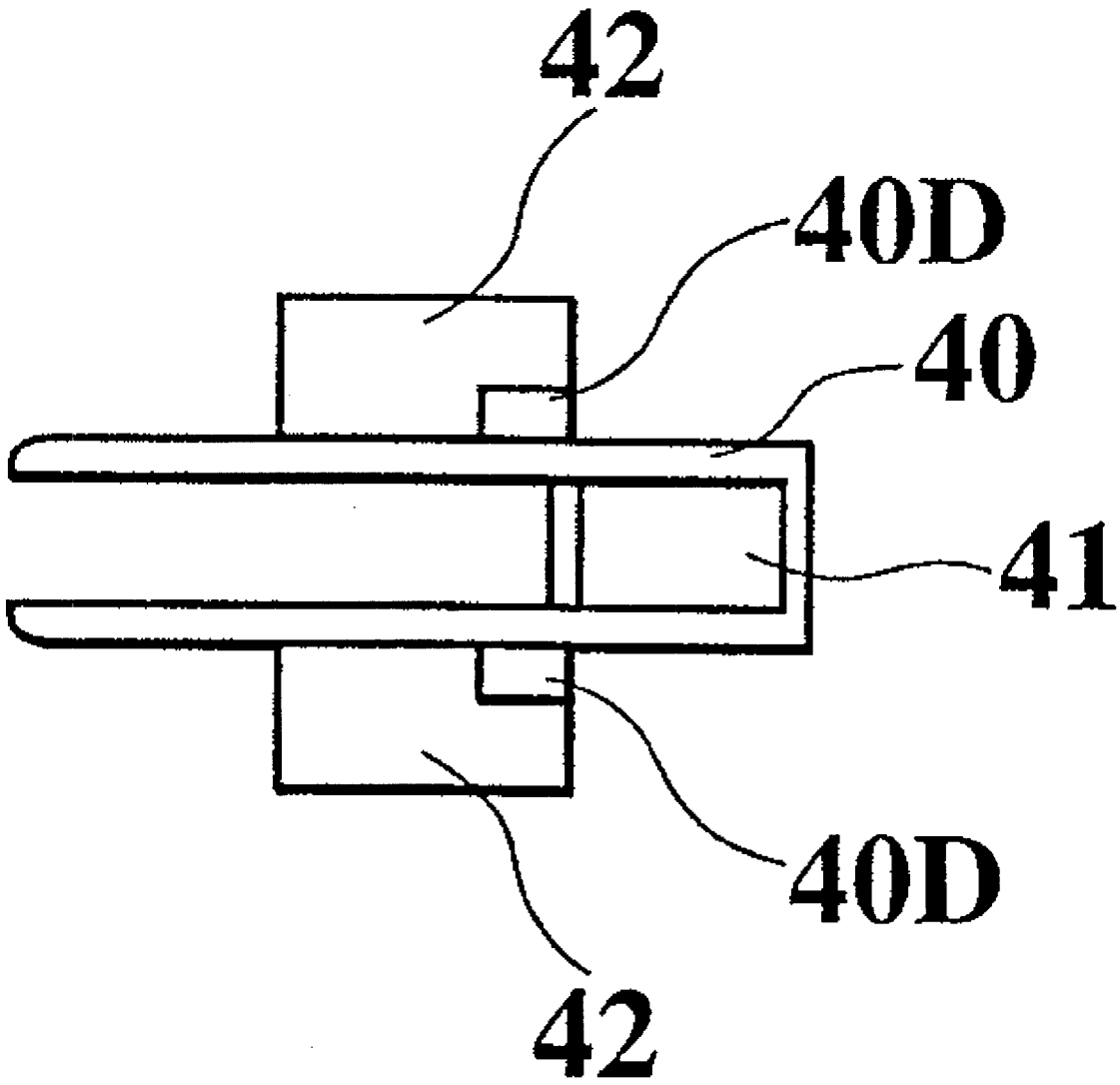
FIG. 6C is a front view thereof.

The engaging lever 32 comprises a pair of lever plates 40 and 40 whose base ends are pivotally supported on the upper and lower surface of the first connector body 31 by the pivots 33 and 33, and a connecting plate 41 for integrally connecting free ends of the lever plates 40 and 40. FIGS. 6A to 6C show the engaging lever 32 in a state where it is not mounted to the first connector body 31.

One side peripheral edges 40A at base ends of the lever plates 40 and 40 are set such as for form arcs whose centers correspond to the pivots 33. Further, the side peripheral edge 40A and the front surface 37A of the side of the first projection 37 having the substantially triangular plane are set to be located in position opposed to each other. The front side surface 37A is formed such as to curve in correspondence with the side peripheral edge 40A of the lever plate 40. Therefore, the side peripheral edge 40A rotates along the front side surface 37A of the first projection 37 around the pivot 33

Side surfaces 40B of the lever plates 40 and 40 facing the first projection 37 are set such as to be opposed to the rear side surface 37B of the side of the first projection 37. The rear side surface 37B is extended rearward of the front side surface 37A and formed into flat surface. With this structure, the rear side surface 37B of the first projection 37 abuts against the side surface 40B of the lever plate 40, thereby restricting the rotation range of the engaging lever 32. The second projections 38 are disposed and formed on front ends of the upper and lower surfaces of the first connector body 31. The rear side surfaces of the second projections 38 abut against side surfaces 40C of the base ends of the lever plates 40, thereby restricting the rotation range of the engaging lever 32.

Further, connecting projections 401) are formed such as to project from front ends of the lever plates 40 in the vicinity of the side peripheral edges 40A. Cover levers 42 are formed on the opposite side of the connecting projection 40D with respect to the pivots 33. Engaging projections 43 having height lower than that of the cover levers 42 are projected form the lever plates 40 at locations closer to free ends of the cover levers 42. Each of the engaging projections 43 is disposed sideway (in a direction separating away from the side surface 40B of the lever plate 40) from a line connecting the cam lever 42 and the pivot 33. As described above, the engaging projections 43 are inserted through the insertion notches 27A and 27B formed in the upper and lower side edges of the mounting opening 26 of the mounting member 20.

At that time, since the projecting height of the cam lever 42 is higher than that of the engaging projection 43, and the cam lever 42 is formed sideway (in a direction approaching the side surfaces 40B of the lever plates 40) of the engaging projection 43, the cam lever 42 can not pass through the insertion notches 27A and 27B.

Further, temporarily mounting notches 44 capable of engaging with and disengaging from the temporarily mounting projections 31A projecting from the upper and lower surfaces of the first connector body 31 are formed in the peripheral edges of the sideway (in a direction separating away from the side surfaces 40B of the lever plates 40) of the portions of the lever plates 40 pivotally supported by the pivots 33.

Figure 9:
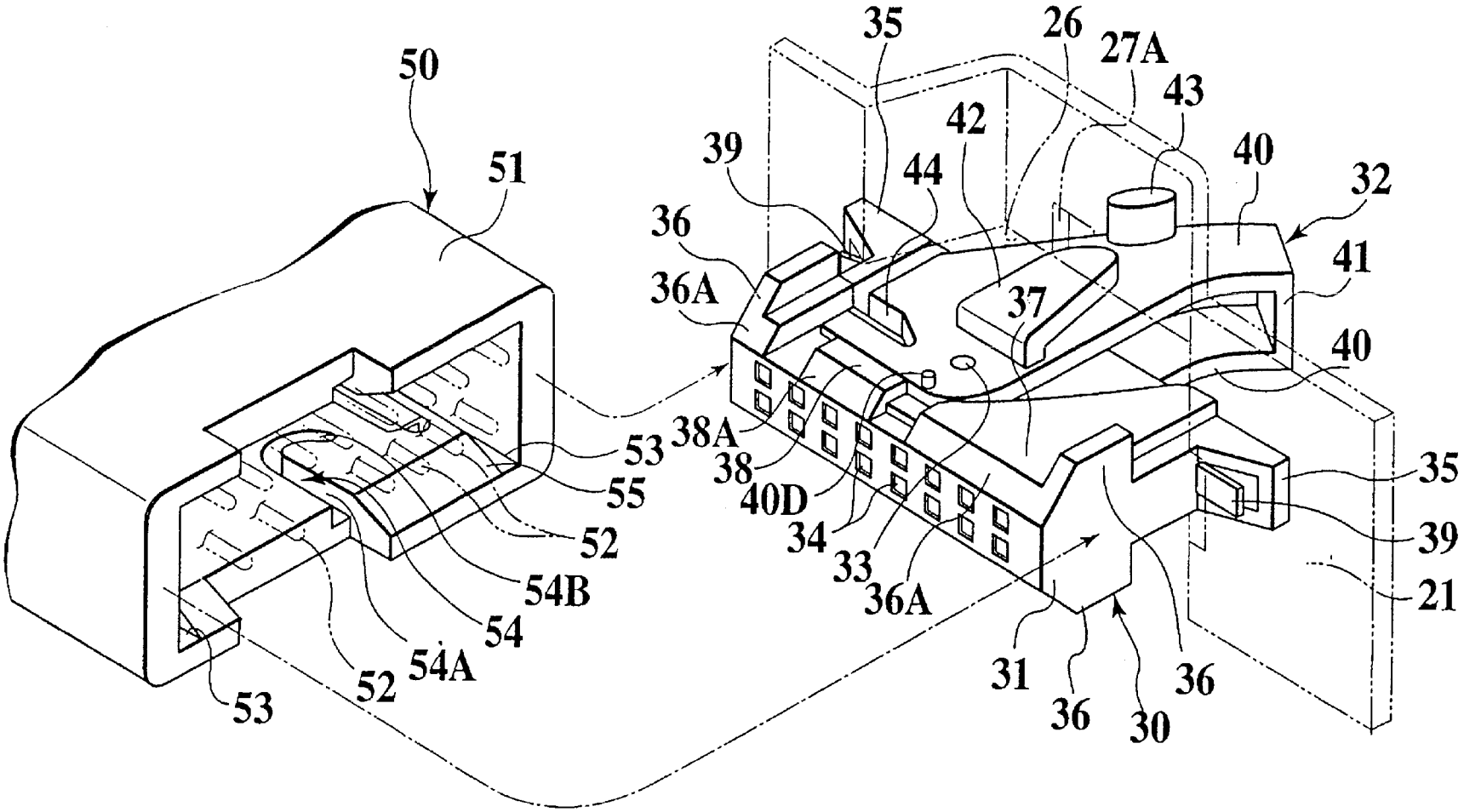
FIG. 9 is a perspective view showing a state in which a second connector is mounted to the temporarily mounted first connector in the first embodiment.

Next, a structure of a second connector 50 will be explained using FIG. 9. As shown in FIG. 9, the second connector 50 comprises a prism-like second connector body 51 into which the first connector 30 is fitted and accommodated, and a plurality of male terminal metal fitting 52 disposed in the second connector body 51. Guide grooves 53 and 53 for guiding the guide projections 36 and 36 of the first connector body 31 are formed in opposite sides of upper and lower inner wall surfaces of the second connector body 51. Guide grooves 54 for guiding the connection projections 40D and 40D formed on the engaging lever 32 of the first connector 30 are formed in the opposite sides of the upper and lower inner wall surfaces of the second connector body 51. Each of the guide grooves 54 comprises an introducing groove portion 54A extending straightly from an opening edge of the second connector 50 toward a bottom thereof, and a curved groove portion 54B extending such as to curve from an end of the introducing groove portion 54A sideway. As shown in FIG. 9, guide inclined surfaces 55 for sliding with the inclined surfaces 36A and 38A of the first connector body 31 to easily guide the second connector 50 into a normal fitting position are formed on the upper and lower wall surfaces of the opening of the second connector body 51.

The structure of the mounting member 20, the first connector 30 and the second connector 50 constituting the connector supporting mechanism of the first embodiment has been explained above. Next, assembling method, effect and operation of the first embodiment will be explained.

In the first embodiment, as shown in FIG. 4, the rear end of the first connector 30 is first turned such as to be opposed to the mounting member 20. At that time, the electric wires connected to the female terminal metal fittings accommodated and disposed in the first connector 30 may be led backside of the mounting member 20 through the mounting opening 26 of the mounting member 20, or may be connected to the first connector body 31 after the electric wires are pulled out through the mounting opening 26 from the backside of the mounting member 20. In the first embodiment, since the tip end of the engaging lever 32 is bent sideway as shown in FIG. 4, it is easy to pull out the electric wires from the rear end of the first connector body 31.

Figure 7A:
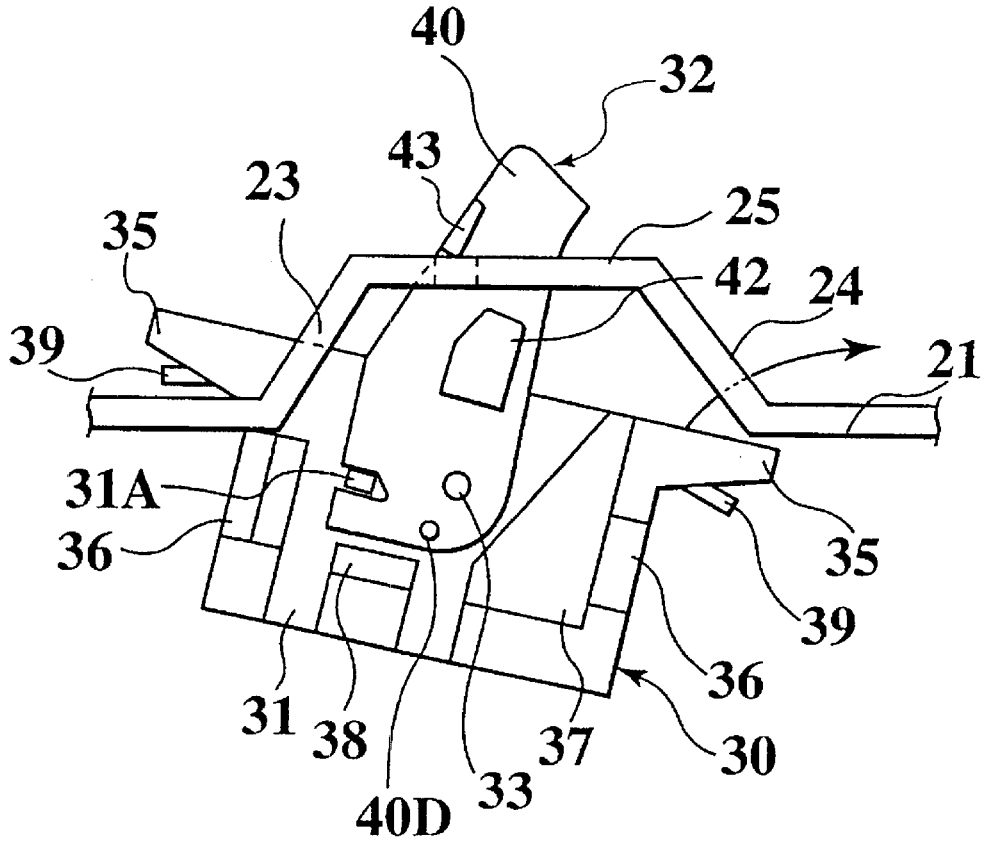
FIG. 7A is a plan view for explaining an initial mounting stage between the mounting member and the first connector of the first embodiment.
Figure 7B:
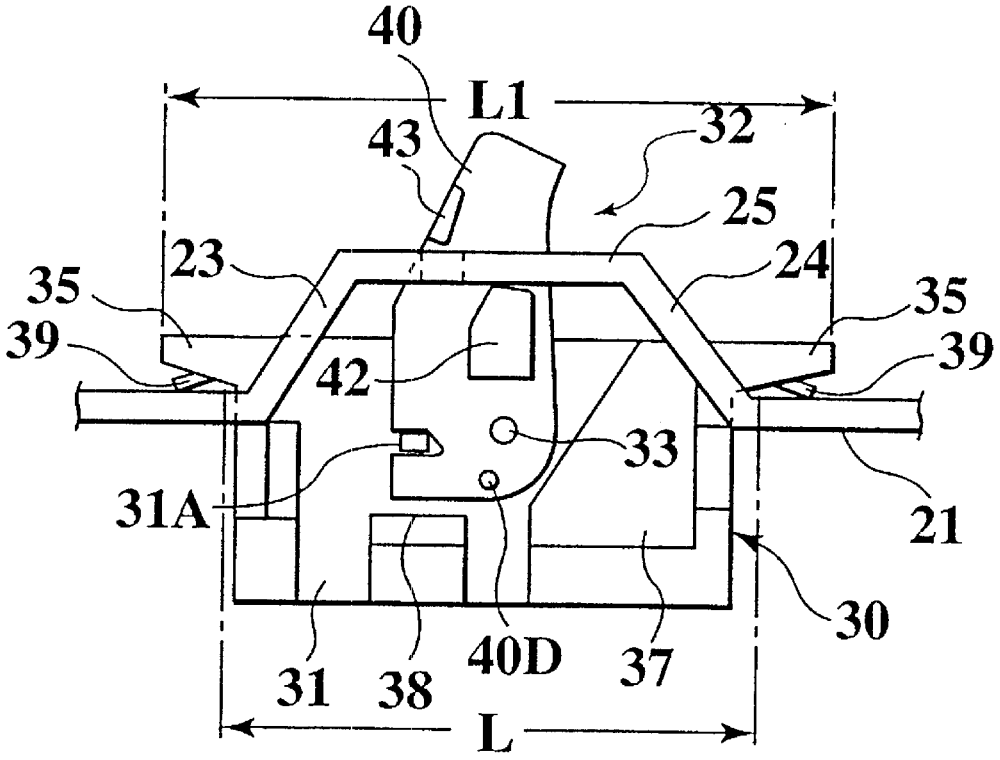
FIG. 7B is a plan view for explaining a state in which the first connector is temporarily mounted in the mounting member in the first embodiment.

Next, as shown in FIG. 7A, one of the stoppers 35 of first connector pass through the mounting opening 26 of the mounting member 20. If the first connector 30 is inclined with respect to the reference surfaces of the stay member 21 as shown in FIG. 7A, the other stopper 35 can pass through the mounting opening 26. At that time, since the temporarily mounting projection 31A projecting from the first connector body 31 is locked to the temporarily mounting notch 44 formed in the lever plate 40 of the engaging lever 32, the engaging lever 32 is kept in its projecting state with a predetermined angle (substantially right angle) with respect to the rear end surface of the first connector body 31. Therefore, the engaging projection 43 formed on the front end of the lever plate 40 passes through the insertion notches 27A and 27A formed in the peripheral edges of the mounting opening 26 and moves to the backside of the bottom surface 25.

After both the stoppers 35 of first connector 30 pass through the mounting opening 26 and move to backside of the stay member 21, both the resilient pieces 39 are brought into contact under pressure with back surfaces (step portions steps 22A and 22A of the reference surfaces 22 and 22 of the mounting, opening 26. As a result, the first connector 30 is biased in a direction in which the first connector 30 is inserted into the mounting opening 26 by repulsion force of the resilient pieces 39, but since the front end of the cam lever 42 formed on the lever plate 40 abuts against the front surface of the bottom surface 25, this biasing force is maintained. Therefore, the first connector 30 is temporarily mounted to the mounting member 20.

Figure 8A:
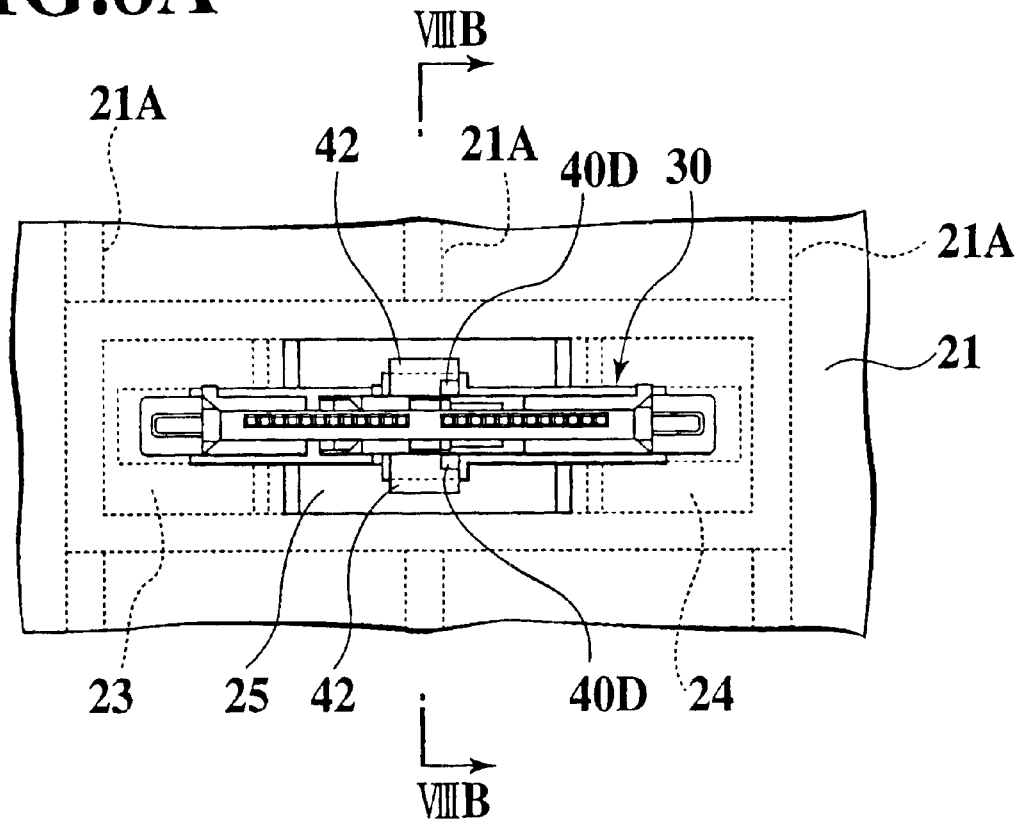
FIG. 8A is a plan view showing a state in which the first connector is temporarily mounted in the mounting member in the first embodiment.
Figure 8B:
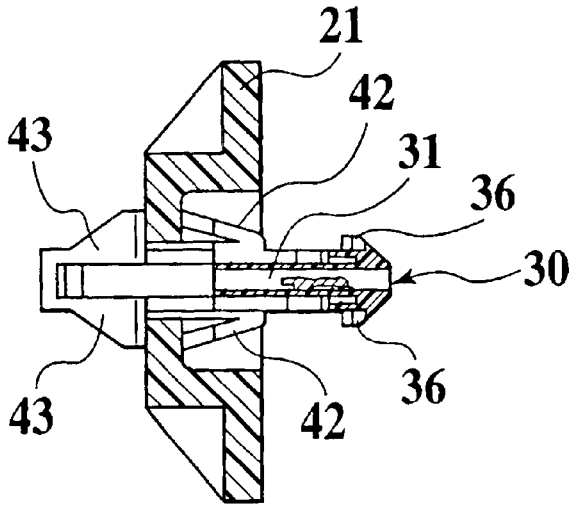
FIG. 8B is a sectional view taken along the line VIIIB—VIIIB in FIG. 8A.

That is, in the first embodiment, it is possible to temporarily mount the first connector 30 by a simple operation in which the first connector 30 is inserted into the mounting opening 26 to bring the resilient pieces 39 and 39 into contact under pressure with the back surfaces (steps 22A and 22A) of the reference surfaces 22 and 22. FIG. 8A is a front view showing a state in which the first connector 30 is temporarily mounted in the mounting member 20, and FIG. 8B is a sectional view taken along the line VIIIB—VIIIB in FIG. 8A. As shown in FIG. 8A, by appropriately forming the ribs 21A on the back surface of the stay member 21 for reinforcing the latter. The ribs 21A may not be provided if unnecessary.

Figure 10:
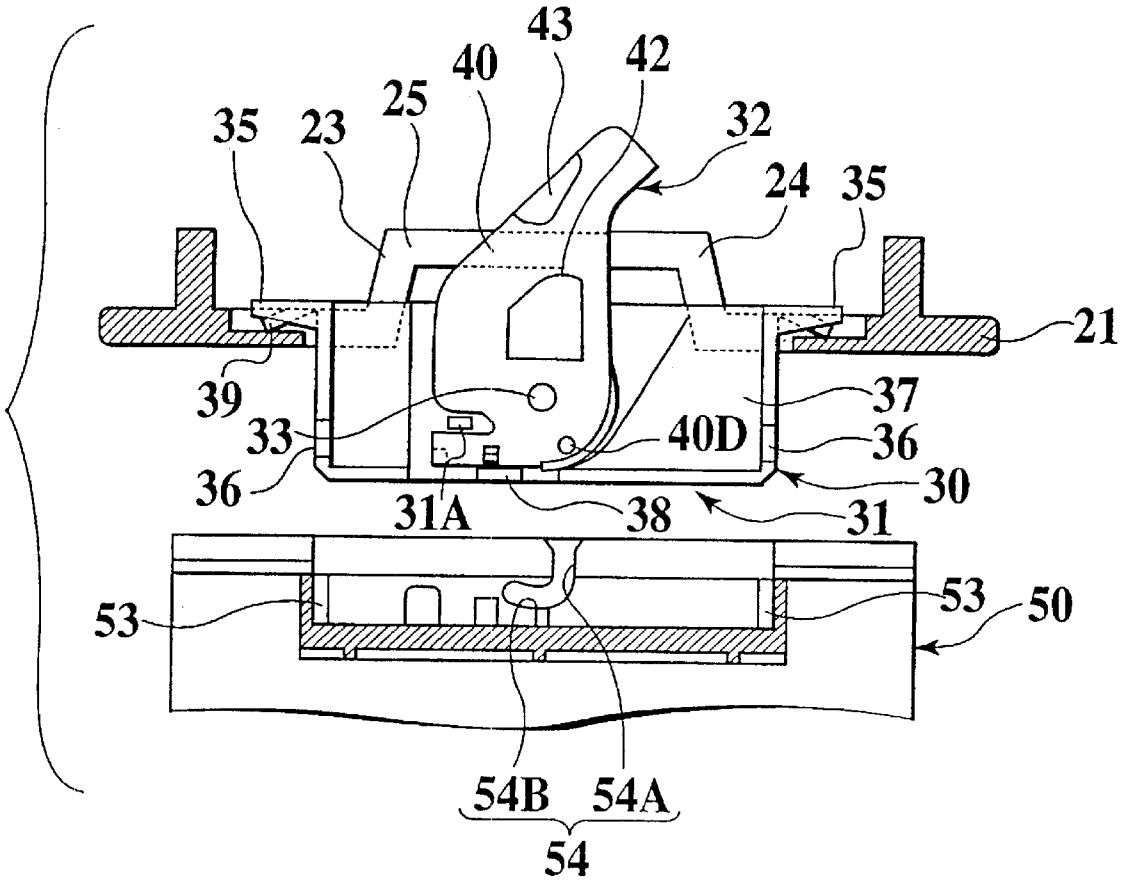
FIG. 10 is a partial sectional view of a flat portion showing, a state in which the second connector is mounted to the temporarily mounted first connector in the first embodiment.

Next, as shown in FIGS. 9 and 10, the second connector 50 is mounted to the first connector 30 mounted to the mounting member 20. That is, the second connector 50 is allowed to approach the front end surface of the first connector 30 in a state where the opening end surface of the second connector 50 is opposed to the end surface of the first connector 30, and the first connector 30 is fitted into the opening. First, when the opening end surface of the second connector 50 is fitted over the front end of the first connector 30 shallowly, the guide projections 36 of the first connector 30 enter the guide grooves 53, 53 formed on the opposite sides of the upper and lower inner wall surfaces of the second connector 50. In the first embodiment, since the front end surface of each the guide projection 36 is inclined, the guide projection 36 is easily guided into the guide groove 53.

At the same time, the connecting projections 40D formed on the upper and lower lever plates 40 of the engaging lever 32 of the first connector 30 are guided into the introducing groove portions 54A of the guide grooves 54 formed in the upper and lower inner wall surfaces of the second connector 50. At the initial mounting stage of first connector 30 and the second connector 50, in the first connector 30, the temporarily mounting projections 31A projecting from the first connector body 31 are locked to the temporarily mounting notches 44 formed in the engaging lever 32, the introducing groove portions 54A and the connecting projections 40D are disposed in the corresponding positions.

Thereafter, if the second connector 50 is pushed in a direction in which the second connector 50 is fitted to the first connector 30, the connecting projections 40D reach the curved groove portions 54B formed at the terminations of the introducing groove portions 54A. If the second connector 50 is further pushed, the connecting projections 40D slide along the curved surfaces of the curved groove portions 54B. If the connecting projections 40D slide along the curved surfaces of the curved groove portions 54B of the second connector 50 in this manner, the engaging lever 32 gets over the temporarily mounting projections 31A to release the engagement, and the engaging lever 32 is turned around the pivots 33. At that time, the cam lever 42 which is in abutment against the front surface of the bottom surface 25 slides and moves on the front surface of the bottom surface 25 together with the engaging lever 32. As shown in the drawing, since the tip end of the cam lever 42 is formed into R-shape, the cam lever smoothly moves on the front surface of the bottom surface 25 as the engaging lever 32 is turned.

Figure 11:
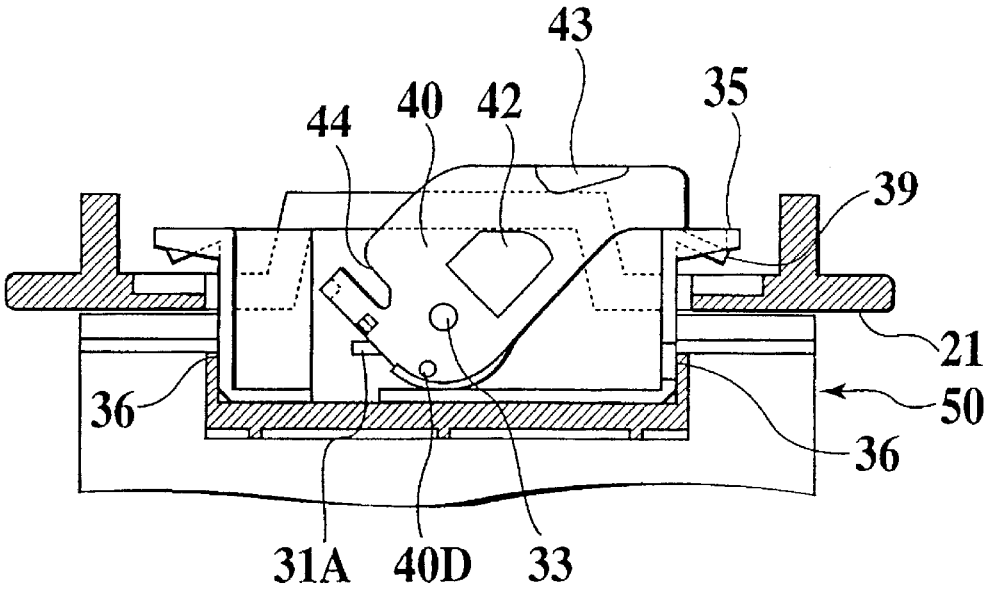
FIG. 11 is a partial sectional view of the flat portion showing a state in which the second connector is mounted to the first connector in the first embodiment.

As a result, as shown in FIG. 11, the engaging lever 32 is turned, and the engaging projections 43 projecting from the tip ends of the lever plates 40 come into contact under pressure with the back surface of the bottom surface 25. At that time, although the tip ends of the cam levers 42 arc also pushed backward, since the cam levers 42 come into contact with the front surface of the bottom surface 25 under pressure, the engaging lever 32 is rotated in the clockwise direction in FIG. 11, and the bottom surface 25 is sandwiched between the engaging projection 43 and the cam lever 42 as shown in FIG. 11. In this state, as shown in FIG. 11, the peripheral surface of the lever plate 40 and the temporarily mounting projection 31A are engaged with each other to prevent the lever plates 40 from turning in the opposite direction. As a result, the first connector 30 is supported by and fixed to the mounting member 20. Since the second connector 50 is engaged with the connecting projections 40 projecting from the lever plates 40 of the first connector 30 and the curved groove portions 54B, the fitting state is maintained. In the process in which the first connector 30 and the second connector 50 are fitted to each other, the female terminal metal fittings provided on the side of the first connector 30 and the male terminal metal fittings 52 provided on the side of the second connector 50 are fitted to each other, thereby establishing the electric connection.

The assembling method, the effect and the operation of the first embodiment were explained above. In the first embodiment, the second connector 50 is mounted to the first connector 30 in a state where the first connector 30 is temporarily mounted to the subject ember 20. When the mounting operation of the second connector 50 is completed, the first connector 30 is reliably fixed to the mounting member 20, and the second connector 50 is also reliably mounted to the first connector 30.

Especially, in the first embodiment, since the first connector 30 can be fixed to the mounting member 20 without using special fixing means such as screws, the mounting operation is extremely easy. Further, since the mounting member 20, the first connector 30 and the second connector 50 can be integrally and strongly fixed to one another utilizing the inserting force of the second connector 50 in the state where the first connector 30 is temporarily mounted to the mounting member 20, force used for the operation can efficiently be utilized, and the mounting operation can be carried out swiftly and reliably. Further, when the first connector 30 is fitted to the second connector 50, since the inclined surfaces 36A, 38A and the guide inclined surfaces 55 are slide, the second connector 50 is easily guided to the normal fitting position.

As described above, according to the first embodiment, it is possible to realize an inexpensive connector supporting mechanism capable of reducing the number of parts and an assembling operation can easily and reliably be carried out.

To detach the second connector 50 and the first connector 30 from the mounting member 20, the engaging levers 32 get over the temporarily mounting projections 31A and rotate in the opposite direction by pulling the second connector 50, the connecting projections 40D move from the curved groove portions 54B toward the introducing groove portions 54A, and the second connector 50 can be pulled out. Further, if one of the stoppers 35 and one of the resilient pieces 39 of the first connector 30 are detached from the mounting member 20, and if the other stopper 35 and the other resilient piece 39 are detached, the first connector 30 can be detached from the mounting member 20.

Second Embodiment

FIGS. 12 to 16 show a second embodiment of the connector supporting mechanism of the present invention.

The connector supporting mechanism of the present embodiment comprises a mounting member 61 formed on a stay member 60 of an automobile for example, a first connector 70 to be mounted to the mounting member 61, and a second connector 80 as a female connector to be mounted to the first connector 30.

Figure 12:
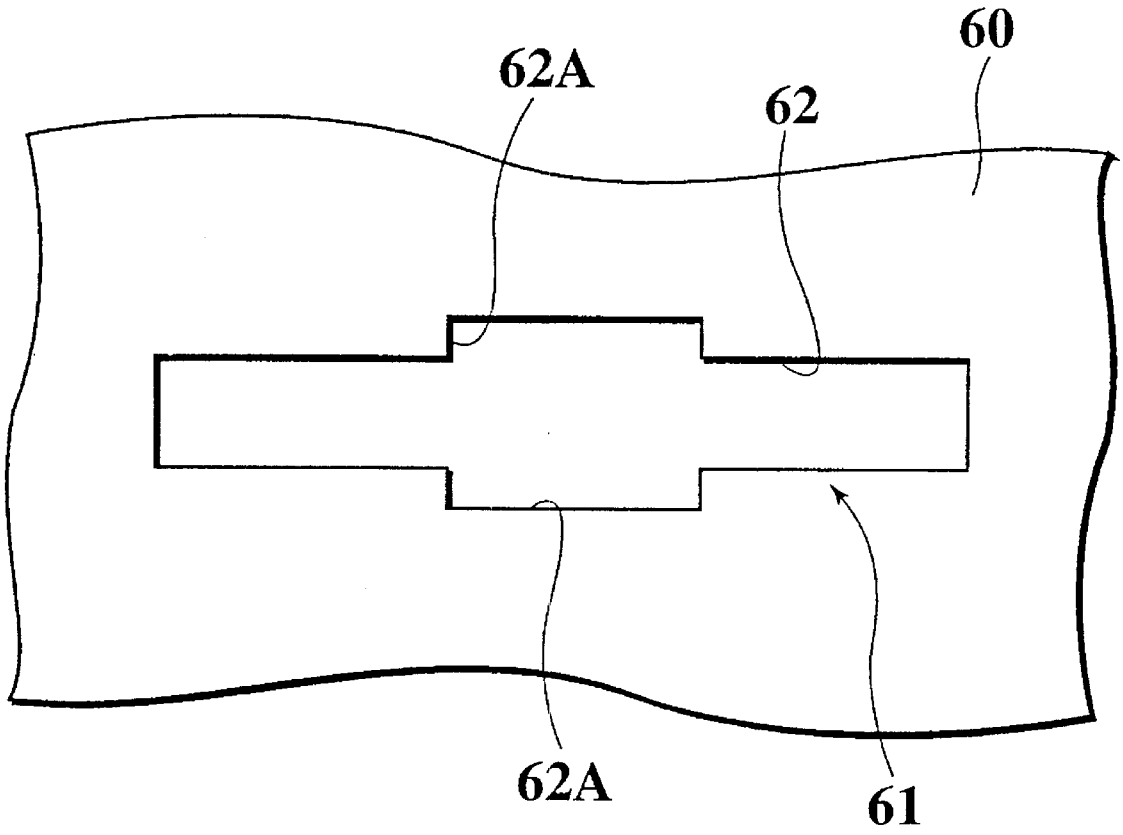
FIG. 12 is a front view showing a mounting member according to a second embodiment of the connector supporting mechanism of the present invention.

As shown in FIG. 12, the mounting member 61 is formed by making a mounting opening 62 in the stay member 60. The mounting opening 62 is formed at its centers of upper and lower edges with insertion notches 62A.

The first connector 70 comprises a substantially rectangular parallelepiped first connector body 71, and a pair of engaging levers 72, 72 formed on upper and lower surfaces of the first connector body 71.

The first connector body 71 is formed with a terminal accommodating chamber in which a plurality of female terminal metal fitting are accommodated as in the first embodiment. These female terminal metal fittings are electrically connected to female terminal metal fittings of the second connector 80 at the front end of the first connector body 71. Guide projections 73. 73 are formed on opposite sides of upper and lower surfaces of front end of the first connector body 71.

The engaging levers 72, 72 are independently turnably supported pivotally by pivots 74, 74 at the upper and lower surface of the first connector body 71. One ends of the engaging levers 72 project rearward from a rear end of the first connector body 71. Each of the engaging levers 72 is formed at its rear tip end with a first engaging projection 75 and a second engaging projection 76. The second engaging projection 76 is set such that it is located sideway from a line connecting the first engaging projection 75 and the pivot 74. Each of the engaging levers 72 is formed at its front tip end with a connecting projection 77. Temporarily mounting projections 78 are formed on predetermined positions of the upper and lower surfaces of the first connector body 71. The temporarily mounting projection 78 and a peripheral edge 72A of the engaging lever 72 engage with each other, and the engaging lever 72 is temporarily mounted.

The second connector 80 is of prism-like shape, and if the first connector 70 is inserted into the second connector 80, the second connector 80 is connected to the female terminal metal fittings disposed in the first connector 70. A plurality of male terminal metal fittings (not shown) are provided. Guide groove portions 81 corresponding to the guide projections 73 formed on the first connector body 71 are formed on opposite sides of upper and lower inner wall surfaces of the second connector 80. These upper and lower inner wall surfaces are formed at their centers with connecting groove portions 82 extended inward from the opening edge of the second connector 80. Each of the connecting groove portions 82 comprises an introducing groove portion 82A which is straightly extending inward from the opening edge, and a curved groove portion 82B which is curved inward from the termination of the introducing groove portion 82A. The second connector 80 is formed at its inner wall surface with the pair of connecting grooves 82, and the curved groove portions 82B of the connecting grooves 82 are formed such that the curved groove portions 82B extend in a direction approaching each other.

Next, assembling method, effect and operation of the mounting member 61, the first connector 70 and the second connector 80 of the second embodiment will be explained.

Figure 13:
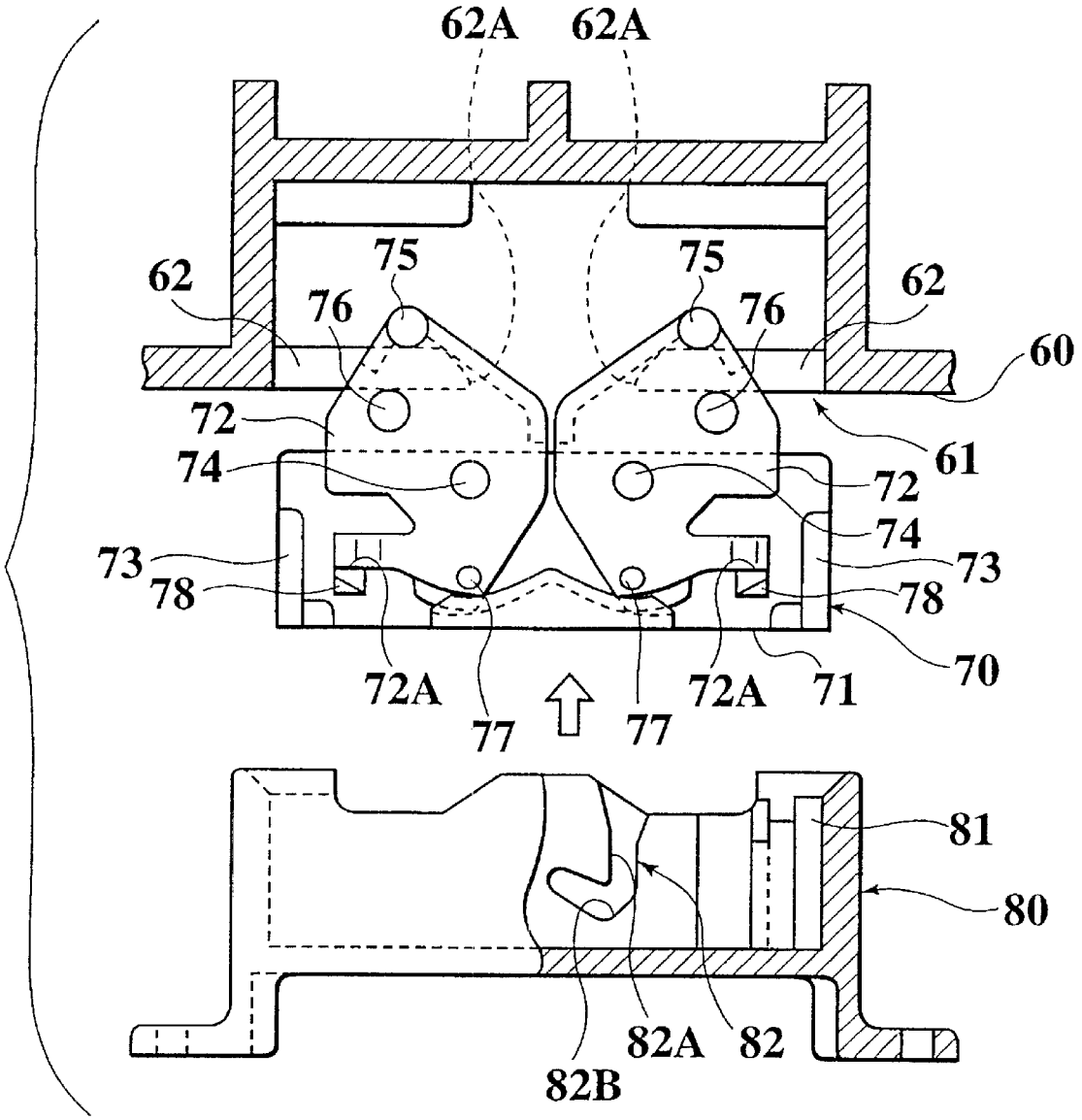
FIG. 13 is a partial sectional view of a flat portion showing a state in which a second connector is mounted to a first connector which is temporarily mounted to the mounting member in the second embodiment.
Figure 14:
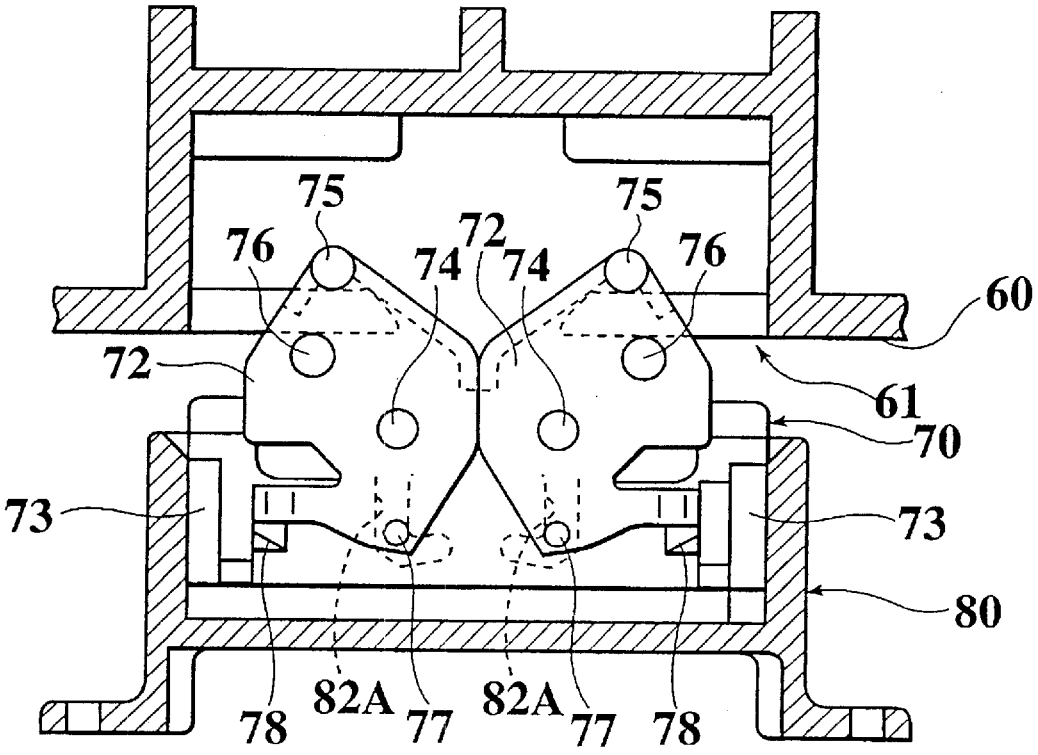
FIG. 14 is a partial sectional view of the flat portion showing an intermediate state in which the second connector is mounted to the first connector in the second embodiment.
Figure 15:
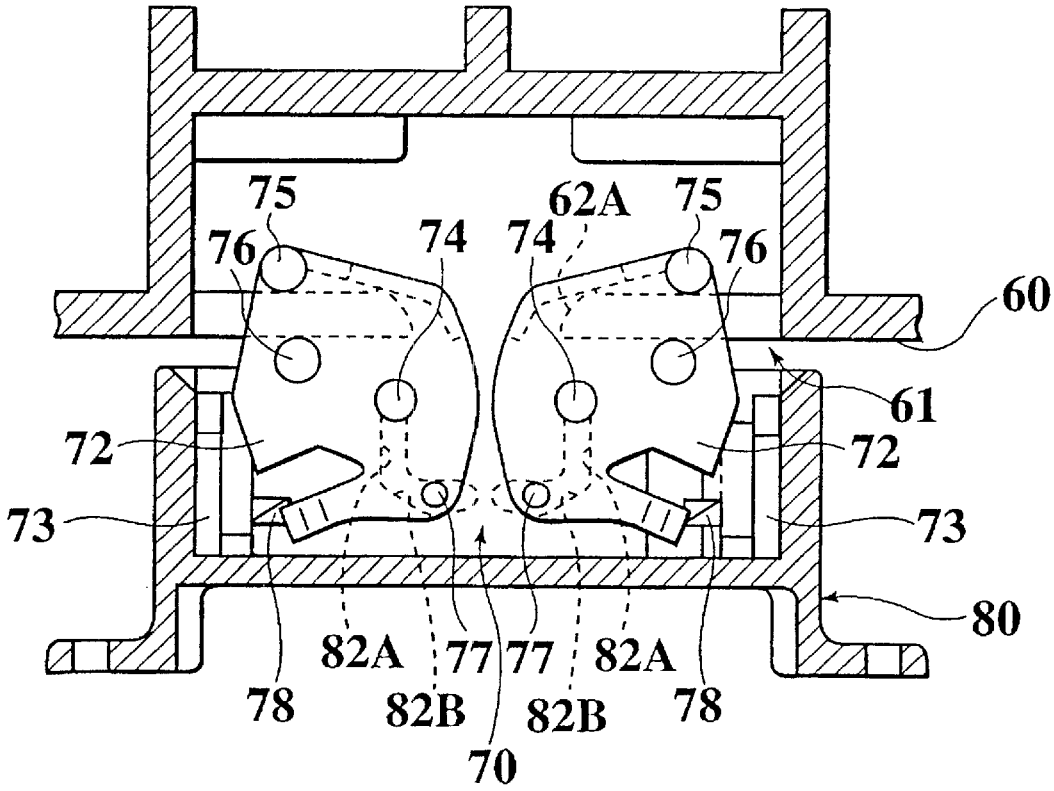
FIG. 15 is a partial sectional view of the flat portion showing an intermediate state in which the second connector is mounted to the first connector in the second embodiment.

First, as shown in FIG. 12, the first connector 70 is assembled to the mounting member 61 formed on the stay member 60. In this case, the first engaging projections 75 projecting from the upper and lower engaging levers 72 located one side of the widthwise direction of the first connector 70 are once inserted into the insertion notches 62A, 62A, and the other first engaging projections 75 formed on the other upper and lower engaging lever 72 are inserted into the insertion notches 62A, 62A, thereby establishing the temporarily mounting state as shown FIG. 13. In this state, plate portions of the one side insertion notches 62A are sandwiched between the first engaging projections 75 and the second engaging projections 76 as shown in FIG. 13. Therefore, in this state, the first connector 70 is temporarily mounted to the mounting member 61. Thus, the first connector 70 is temporarily mounted to the mounting member 61 slight loosely.

Next, as shown in FIG. 13 the second connector 80 is allowed to approach the first connector 70, and the second connector 80 is fitted to the first connector 70 (see FIG. 14) such that the guide projections 73 formed on the opposite sides of the front end upper and lower surfaces of the first connector body 71 are fitted to the guide groove portions 81 formed on the opposite sides of the upper and lower inner wall surfaces of the second connector 80. At that time, the connecting projections 77 formed on the engaging levers 72 slide and reach the entrance of the curved groove portions 82B in a state where the connecting projections 77 are accommodated in the introducing groove portions 82A formed in the upper and lower inner wall surfaces of the second connector 80.

Thereafter, if the second connector 80 is further pushed and fitted to the first connector 70, the connecting projections 77 rotate and move along the curved surfaces of the curved groove portions 82B to turn the engaging levers 72. The engaging levers 72, 72 rotate in a direction in which first engaging projections 75 are separated from each other in accordance with the shapes of the curved groove portions 82B. If the first engaging projections 75 are separated from each other and the engaging levers 72 are turned, the first connector 70 is pulled toward the mounting member 61 around the first connector engaging projections 75 as fulcrums.

Figure 16:
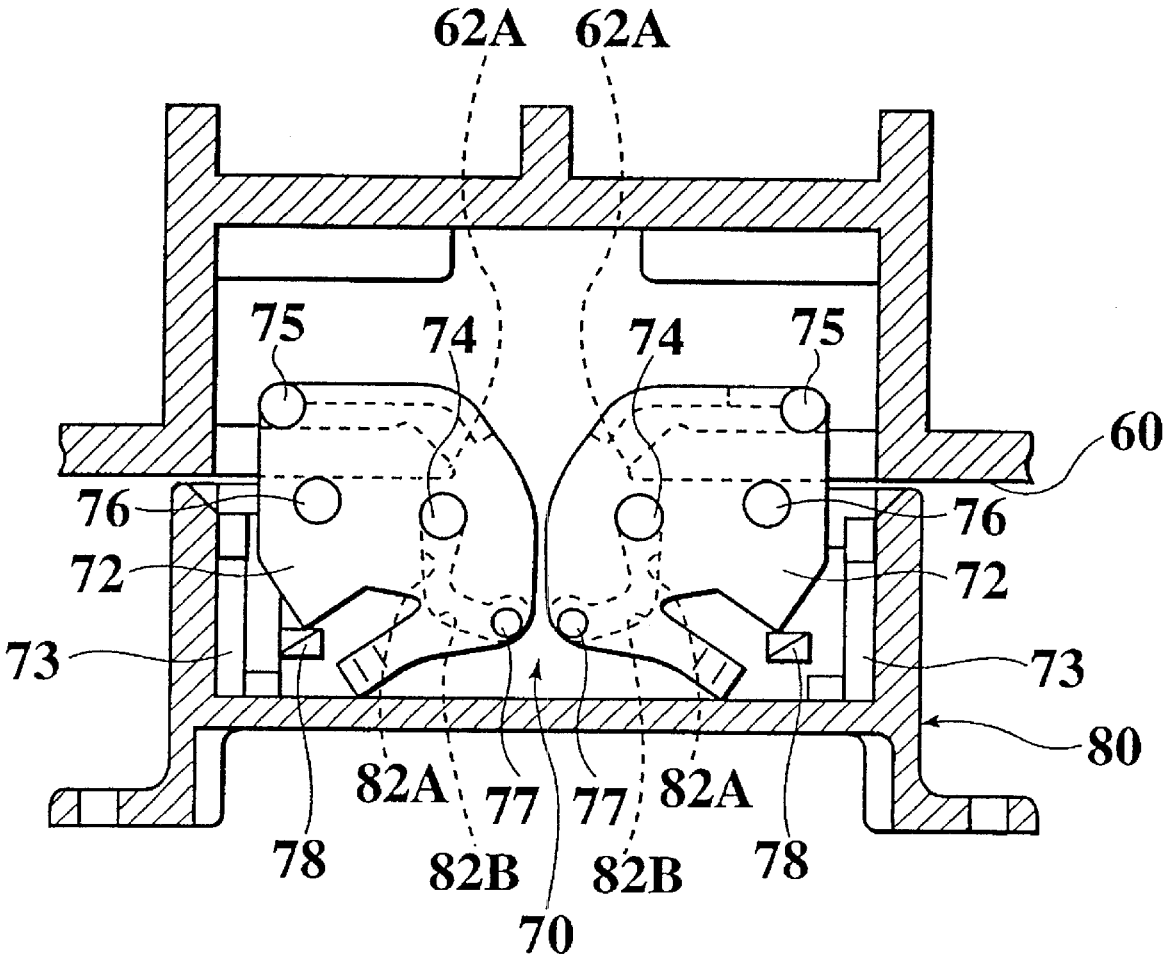
FIG. 16 is a partial sectional view of the flat portion showing a state in which the second connector is completely mounted to the first connector in the second embodiment.

If the second connector 80 is further pushed, as shown in FIG. 16, the connecting projections 77 reach the terminations of the curved groove portions 82B, and with this movement, the engaging levers 72 further rotate in a direction separating the first engaging projections 75 away from each other. Then, the engaging levers 72 get over the temporarily mounting projections 78 formed on the first connector body 71 and the peripheral edges abut against the temporarily mounting projections 78 so as to prevent the engaging levers 72 from easily rotate in the opposite direction. In this state, the first connector 70 most approaches the mounting member 61, the plate member of the stay member 60 is sandwiched between the first engaging projections 75 and the second engaging projections 76, and the first connector 70 is strongly fixed.

In this state, the second connector 80 is fitted to the first connector 70 completely, and the assembling operation is completed. As a result, the female terminal metal fitting of the first connector 70 and the male terminal metal fittings of the second connector 80 are connected to each other, and the electrical connection is established.

According to the second embodiment, since the mounting member 61 can be sandwiched and temporarily mounted between the first engaging projections 75 and the second engaging projections 76 projected from the rear end of the engaging levers 72, the mounting operation of the connectors is extremely easy, and the connector can be supported with a single motion. Further, since the first connector 70 is temporarily mounted to the mounting member 61 slight loosely, even if the fitting position of the first connector 70 to the second connector 80 is slightly deviated, the first connector 70 can reliably be fitted to the second connector 80 by appropriately deviating the second connector 80. With this design, it is possible to fit the first connector 70 to the second connector 80 even if the first connector 70 can not visually check the layout of a vehicle, it is possible to fit the first connector 70 to the second connector 80 reliably. Further, in the second embodiment, the assembling operation can be carried out only by fitting the second connector 80 to the first connector 70, there is a merit that skill is not required for the operation, and the connectors can be supported reliably.

Although the first and second embodiments have been explained above, the present invention should not be limited to these embodiments, and various changes in design can be made in relation to the subject matter of the structure. For example, although the stoppers 35 and the resilient pieces 39 are provided on the opposite sides of the rear end of the first connector body 31 in the above-described first embodiment, a structure in which the stoppers 35 and the resilient pieces 39 are omitted is also within a range to which the present invention can be applied.

Further, although the pair of engaging levers 72 are provided on each of the opposite side surfaces of the first connector body 71, if at least one pair of engaging levers 72 are provided, the mounting operation can be carried out stably.

DEPOSIT OF COMPUTER PROGRAM LISTINGS

Not Applicable

What is claimed is:

1. A connector supporting mechanism comprising:

a mounting member;

a first connector supported by the mounting member; and a second connecter assembled to an electrically connected to the first connector to be mounted to the mounting member; wherein the first connector comprises a connector body, an engaging lever pivotally supported by a rotation supporting shaft such that a first end of the engaging lever projects from a first end surface of the connector body, an engaging projection projecting from the first end of the engaging lever, and a connecting projection projecting from a second end of the engaging lever; wherein the second connector is formed at its wall with a guide groove for guiding the connecting projection; and the connecting projection is guided in the guide groove to turn the engaging lever by fitting the first connector to the second connector in a first temporary mounting state, wherein the engaging projection is engaged with the mounting member, and the engaging projection is supported by the mounting member.

2. The connector supporting mechanism of claim 1, wherein the engaging lever is provided on each of opposite surfaces of the connector body.

3. The connector supporting mechanism of claim 1, wherein the first end of the connector body is provided with a stopper at each of its opposite sides, wherein the stoppers project sideways and a resilient piece is mounted to an end of each of the stoppers.

4. The connector supporting mechanism of claim 1, wherein the mounting member comprises a mounting panel having a mounting opening; and a cam lever formed at a position nearer to the rotation supporting shaft than the engaging projection formed on the first end of the engaging lever; wherein the engaging projection is engaged with a back surface of the mounting member, and the cam lever is engaged with a front surface of the mounting member.

5. The connector supporting mechanism of claim 4, wherein as the second connector is fitted to the first connector in a second temporary mounting state, wherein the engaging projection is engaged with the back surface of the mounting member and the cam lever is engaged with the front surface of the mounting member, the connecting projection moves along the guide groove to turn the engaging lever, and the engaging projection comes into contact with the back surface of the mounting member under pressure.

* * * * *